US010851483B2

(12) United States Patent
Kallenbach et al.

(10) Patent No.: US 10,851,483 B2
(45) Date of Patent: Dec. 1, 2020

(54) SEWING SYSTEM

(71) Applicant: PFAFF Industriesysteme und Maschinen GmbH, Kaiserslautem (DE)

(72) Inventors: Harald Kallenbach, Heltersberg (DE); Robert Keilmann, Bensheim (DE)

(73) Assignee: PFAFF Industriesysteme und Maschinen GmbH, Kaiserslautern (DE)

( * ) Notice: Subject to any disclaimer, the term of this patent is extended or adjusted under 35 U.S.C. 154(b) by 443 days.

(21) Appl. No.: 15/769,224

(22) PCT Filed: Oct. 18, 2016

(86) PCT No.: PCT/EP2016/074922

§ 371 (c)(1),
(2) Date: Apr. 18, 2018

(87) PCT Pub. No.: WO2017/067900

PCT Pub. Date: Apr. 27, 2017

(65) Prior Publication Data

US 2018/0313012 A1 Nov. 1, 2018

(30) Foreign Application Priority Data

Oct. 19, 2015 (DE) ..... 10 2015 220 332

(51) Int. Cl.
*D05B 57/30* (2006.01)
*D05B 55/14* (2006.01)
(Continued)

(52) U.S. Cl.
CPC ..... *D05B 57/30* (2013.01); *D05B 21/00* (2013.01); *D05B 29/12* (2013.01); *D05B 55/14* (2013.01); *D05B 69/00* (2013.01); *D05B 69/30* (2013.01)

(58) Field of Classification Search
CPC ..... D05B 55/14; D05B 57/30; D05B 57/32; D05B 57/34; D05B 57/36; D05B 69/00; D05B 69/30
See application file for complete search history.

(56) References Cited

U.S. PATENT DOCUMENTS 3,596,619 A * 8/1971 Winberg ..... D05B 57/22 112/151
4,787,324 A 11/1988 Fischer et al.
(Continued)

FOREIGN PATENT DOCUMENTS

DE 36 25 881 A1 2/1988
DE 38 11 897 A1 10/1989
(Continued)

*Primary Examiner* — Nathan E Durham
(74) *Attorney, Agent, or Firm* — McGlew and Tuttle, P.C.

(57) ABSTRACT

A sewing system serves for sewing seams which the multi-dimensionally in space. A needle-bar upper part of a sewing head is mounted so as to be pivotable in a driven manner about a needle-bar longitudinal axis. A gripper lower part is mounted so as to be pivotable in a driven manner, and in a manner synchronous with the needle-bar upper part, about the needle-bar longitudinal axis, in the sewing-head lower part. Motor components for driving the movement of a needle bar, for pivoting the needle-bar upper part, for driving a gripper in a manner synchronous with the needle bar and for pivoting the gripper lower part are disposed outside the needle-bar upper part and outside the gripper lower part. Parts to be sewn that are topographically non-uniform are also rendered accessible.

10 Claims, 7 Drawing Sheets

(51) Int. Cl.

| | |
|---|---|
| ***D05B 69/00*** | (2006.01) |
| ***D05B 21/00*** | (2006.01) |
| ***D05B 29/12*** | (2006.01) |
| ***D05B 69/30*** | (2006.01) |

(56) References Cited

U.S. PATENT DOCUMENTS

| | | | | |
|---|---|---|---|---|
| 2007/0261620 | A1 | 11/2007 | James et al. | |
| 2015/0033996 | A1* | 2/2015 | Wenzel | D05C 7/04<br>112/475.08 |
| 2016/0289875 | A1* | 10/2016 | Morimoto | D05B 19/003 |

FOREIGN PATENT DOCUMENTS

| | | | |
|---|---|---|---|
| DE | 10 2004 027578 | A1 | 2/2005 |
| DE | 10 2011 052 521 | A1 | 2/2013 |
| EP | 2 192 220 | A1 | 6/2010 |
| EP | 2 653 599 | A1 | 10/2013 |
| EP | 2 660 378 | A1 | 11/2013 |
| JP | S52 132244 | U | 10/1977 |
| JP | S58 91379 | U | 6/1983 |
| WO | 2004/113604 | A1 | 12/2004 |

* cited by examiner

SEWING SYSTEM

CROSS REFERENCE TO RELATED APPLICATIONS

This application is a United States National Phase Application of International Application PCT/EP2016/074922, filed Oct. 18, 2016, and claims the benefit of priority under 35 U.S.C. § 119 of German Patent Application, Serial No. 10 2015 220 332.8, filed Oct. 19, 2015, the entire contents of which are incorporated herein by reference.

FIELD OF THE INVENTION

The invention relates to a sewing system for sewing seams which lie multi-dimensionally in space.

BACKGROUND OF THE INVENTION

A sewing system of this type is known by the manifest prior use of the sewing system RS570 of the applicant.

SUMMARY OF THE INVENTION

It is an object of the present invention to refine a sewing system of the type mentioned at the outset in such a manner that parts to be sewn that are topographically non-uniform are also rendered accessible to sewing without complex special constructions being required to this end.

This object is achieved according to the invention by a sewing system for sewing seams which lie multi-dimensionally in space having a sewing head

- having a needle-bar upper part in which a needle bar is mounted so as to be driven in an upward and downward manner along the longitudinal axis of the latter, at least one sewing needle being held as a stitch-formation tool on said needle bar;
- having a sewing-head upper part in which the needle-bar upper part is mounted so as to be pivotable in a driven manner about the longitudinal axis of the needle bar;
- having a gripper lower part on which at least one gripper is mounted as a stitch-formation tool that is driven in a manner synchronous with the sewing needle;
- having a sewing-head lower part in which the gripper lower part is mounted so as to be pivotable in a driven manner, and in a manner synchronous with the needle-bar upper part, about the longitudinal axis of the needle bar;

wherein motor components

- for driving the upward and downward movement of the needle bar,
- for pivoting the needle-bar upper part,
- for driving the gripper in a manner synchronous with the needle bar,
- for pivoting the gripper lower part are disposed outside the needle-bar upper part and outside the gripper lower part.

Moving the motor components outside the parts to be rotated, thus outside the needle-bar upper part and the gripper lower part of the sewing head, enables the components to be rotated to be designed in a very compact manner. The sewing head in this instance can be designed so as to have a freely accessible stitch-formation region, wherein by virtue of the pivotable or rotatable design, respectively, of the needle-bar upper part and of the gripper lower part, any disturbing other components of the sewing system can optionally be pivoted out of a seam region. Topographically demanding sewing tasks can thus also be solved. The sewing system, apart from a sewing machine having the sewing head, can also have a robot for the multi-dimensional positioning of the sewing machine in space. The motors are not conjointly pivoted in the pivoting of the needle-bar upper part and of the gripper lower part in the sewing head. A timing belt drive can be used for pivoting the needle-bar upper part and/or the gripper lower part in the sewing head. The pivot drive for pivoting the needle-bar upper part and the gripper lower part in the sewing head can be designed so as to be independent of the sewing drive for driving the stitch-formation tools. The sewing machine can be a two-needle sewing machine. Said sewing machine can be a chain stitch sewing machine, in particular a double chain stitch sewing machine. A sewing machine of the sewing system can be a post bed sewing machine. The seams to be generated can lie multi-dimensionally so as to be non-planar in space. Drive components for driving the upward and downward movement of the needle bar, in particular the motor components for driving the upward and downward movement of the needle bar, can be embodied as components that do not rotate conjointly with the needle-bar upper part.

A rotatability of the needle-bar upper part and of the gripper lower part, in which the needle-bar upper part and the gripper lower part are mounted in the sewing-head upper part, on the one hand, and in the sewing-head lower part, on the other hand, so as to be rotatable by 360°, enables a particularly flexible use of the sewing system. In principle, the needle-bar upper part and the gripper lower part can be mounted so as to be freely rotatable in the sewing head, thus rotatable by more than 360° in the sewing head.

Tongue-and-groove connections having an annular member, in which the needle-bar upper part by way of at least one tongue-and-groove connection, having an annular member having a groove or a tongue, is operatively connected to a motor component for driving the upward and downward movement of the needle bar, wherein an axis of annular symmetry of the annular member coincides with the needle-bar longitudinal axis or is parallel with the latter, and comprising a presser foot which in the needle-bar upper part in a driven manner is capable of reciprocating along the longitudinal axis of said presser foot, wherein the needle-bar upper part by way of at least one tongue-and-groove connection, having an annular member having a groove or a tongue, is operatively connected to a motor component for driving a reciprocating movement of the presser foot, wherein an axis of annular symmetry of the annular member coincides with the needle-bar longitudinal axis or is parallel with the latter, and in which the needle-bar upper part by way of at least one tongue-and-groove connection, having an annular member having a groove or a tongue, is operatively connected to a motor component for driving a sewn goods transport movement of the needle bar, wherein an axis of annular symmetry of the annular member coincides with the needle-bar longitudinal axis, or is parallel with the latter, enable an operationally reliable coupling of the motor components that are not conjointly pivoted to the pivotable or rotatable components, respectively, thus to the needle-bar upper part and the gripper lower part.

At least one tappet comprising at least one tappet for converting a rotation of a drive shaft to a transport movement of the needle bar and/or to a reciprocating movement of the presser foot, wherein the tappet interacts with the annular member by way of the at least one tongue-and-groove connection, enables a reliable generation of the respective drive movement.

The drive of the reciprocating movement of the presser foot, on the one hand, and a transport movement of the needle bar, on the other hand, can in particular be diverted from one and the same drive shaft by way of respective tappets.

A sliding shaft, in which at least one sliding shaft is disposed in the gripper lower part so as to be parallel with the pivot axis of the gripper lower part, said sliding shaft for driving a gripper movement interacting with the gripper by way of an articulated connection, enables a reliable drive of the gripper movement. The sliding axis of the sliding shaft can coincide with the pivot axis of the gripper lower part.

A gripper drive, in which a gripper drive drives the gripper along two mutually perpendicular movement component, guarantees that the at least one gripper follows in particular a needle transport movement of the assigned needle. In as far as one of the movement components is in each case generated with the aid of a sliding shaft according to the invention, two sliding shafts can be used for driving the gripper along the two movement components. One of the sliding shafts can be embodied as a hollow shaft, the other of the two sliding shafts running therein.

The advantages of a tongue-and-groove connection having an annular member, in which the gripper lower part by way of at least one tongue-and-groove connection having an annular member having a groove or a tongue, is operatively connected to a motor component for driving the gripper, and a tappet conversion comprising at least one tappet for converting a rotation of a drive shaft to an upward and downward movement of the at least one sliding shaft for driving the gripper, wherein the tappet interacts with the annular member by way of the at least one tongue-and-groove connection, in terms of the gripper correspond to those that have already been explained above in the context of the needle-bar drive.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
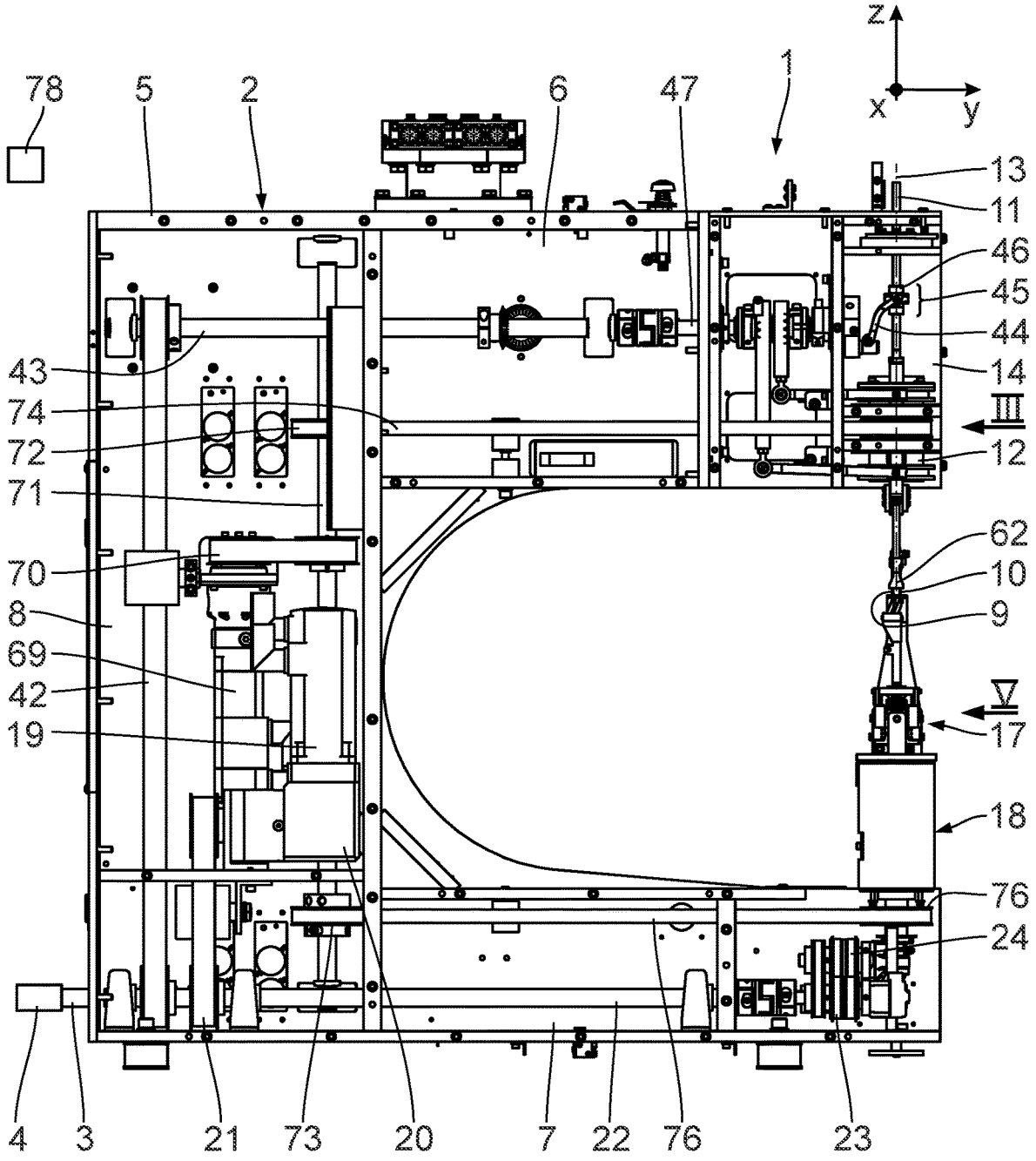
FIG. 1 is a lateral view of a sewing machine in a sewing system for sewing seams that lie multi-dimensionally in space, the lateral view revealing internal details.

A sewing system 1 serves for sewing seams which lie multi-dimensionally, and in particular three-dimensionally in a non-planar manner, in space. An exemplary application for the sewing system 1 is attaching decorative seam applications in the interior of vehicles, for example to dashboards, door side claddings, or armrests. The sewing system 1 includes a sewing machine 2, illustrated in detail in FIG. 1, which is supported by an arm 3 (illustrated only in a schematic manner) of a robot 4 by way of which the sewing machine 2 can be controlled in an arbitrary manner so as to be oriented in space in five or six degrees of freedom.

In order for positional correlations to be facilitated, a Cartesian xyz coordinate system is in each case indicated in the figures. The x-axis, along which, in an initial position of stitch-formation tools which will be described in yet more detail hereunder, the seam is generated, is perpendicular to the drawing plane of FIG. 1 and runs out of the latter. The y-direction in FIG. 1 runs to the right, and the z-direction in FIG. 1 runs upward.

The sewing machine 2 has a housing 5 having a C-shaped basic construction having a housing upper part 6, a housing lower part 7, and a post 8 which connects said two parts so as to form the C-shape. The housing upper part 6 and the housing lower part 7 run along the y-direction. The post 8 runs along the z-direction.

Figure 2:
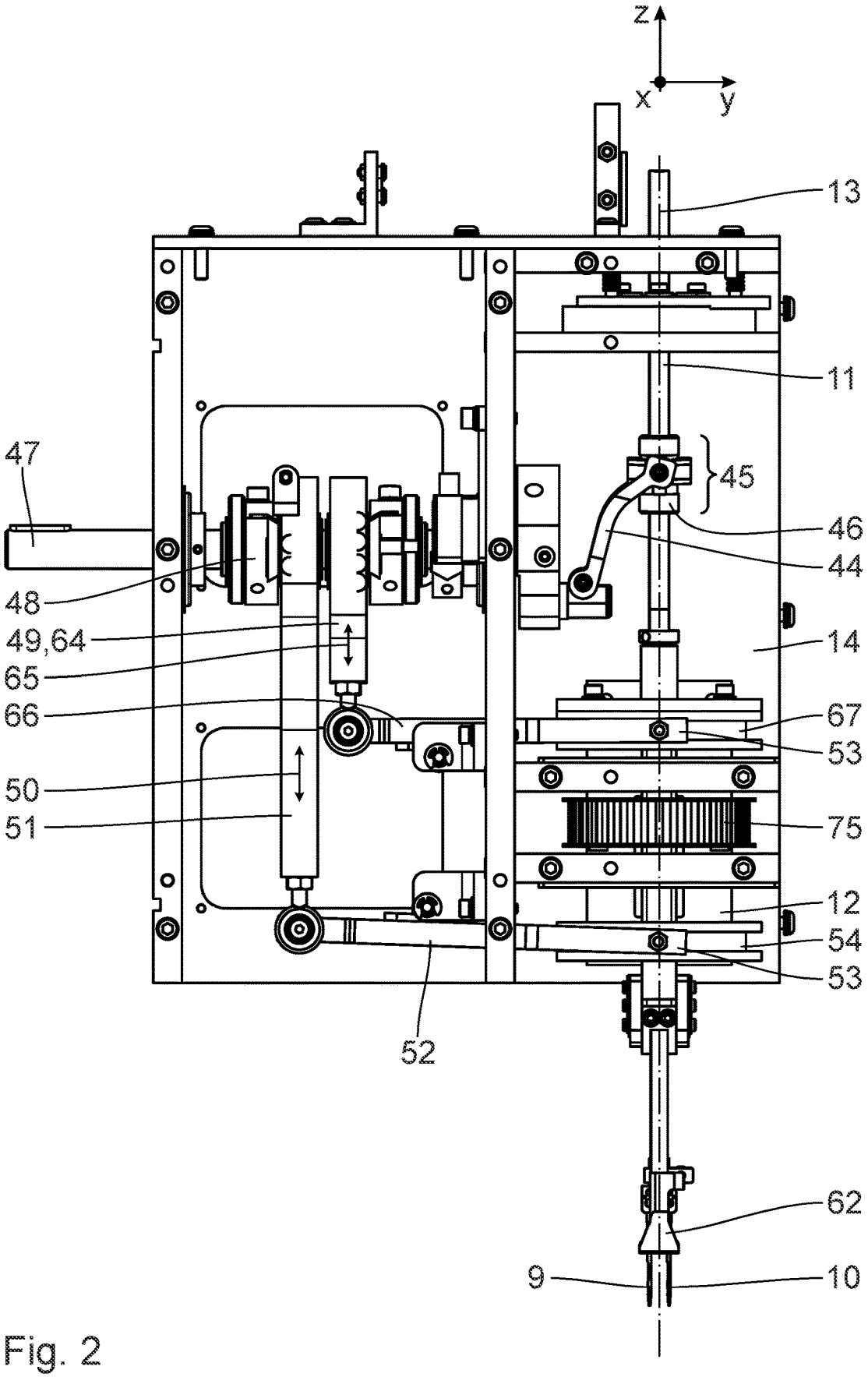
FIG. 2 is an enlarged view of a functional group of the sewing machine at the sewing head, specifically a sewing-head upper part having a needle-bar upper part that is mounted so as to be rotatable therein.
Figure 3:
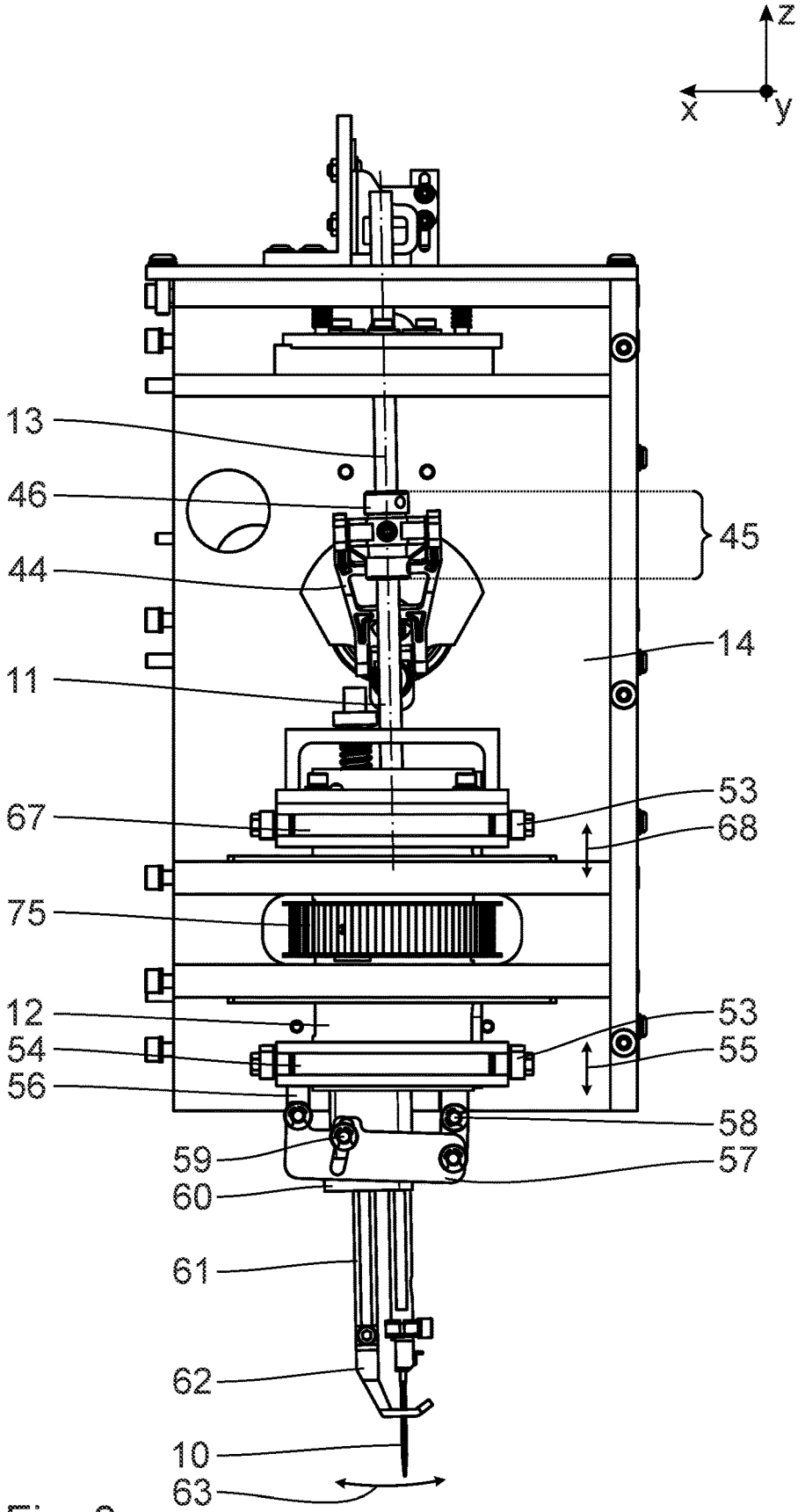
FIG. 3 is a fragmented view of a sewing head of the sewing machine, seen from the viewing direction III in FIG. 1, the view again revealing internal details.
Figure 4:
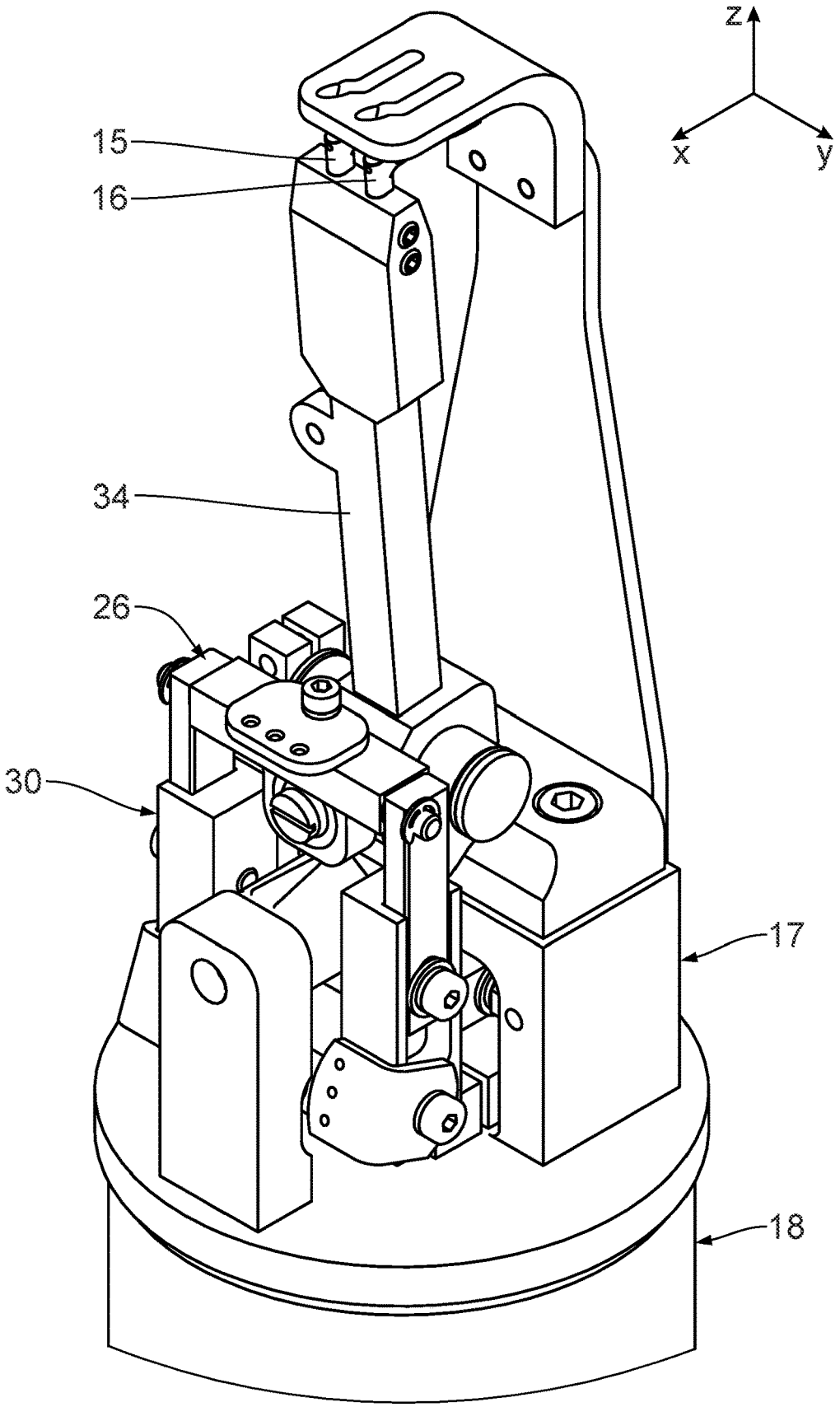
FIG. 4 is a perspective and enlarged view of stitch-formation components of the sewing machine, in particular components of a sewing-head lower part in which a gripper lower part having a gripper is mounted so as to be driven in a pivotable manner and in a manner synchronous with the needle-bar upper part.
Figure 5:
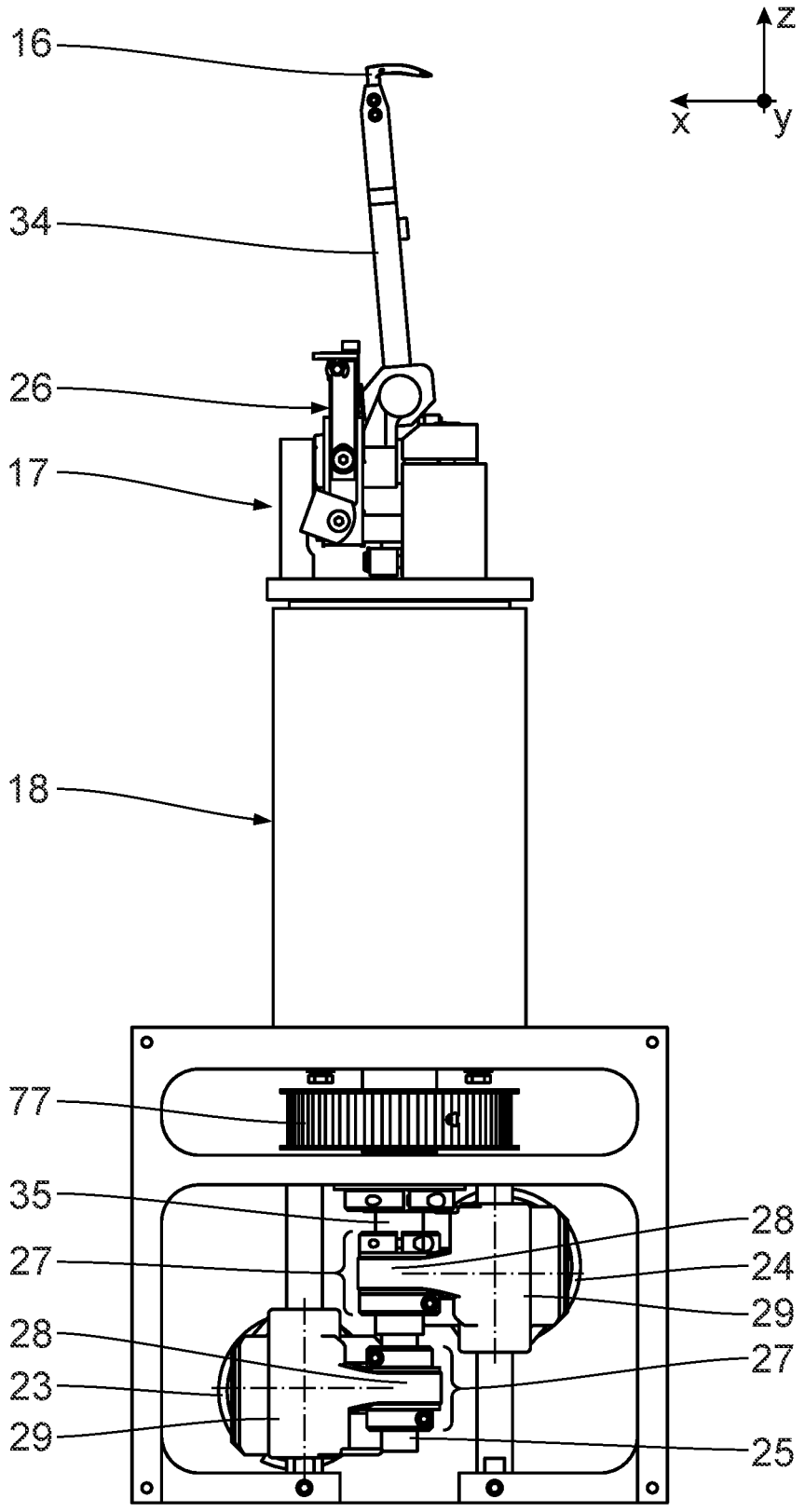
FIG. 5 is a view of the sewing-head lower part, seen from the viewing direction V in FIG. 1, said view again revealing internal details.
Figure 6:
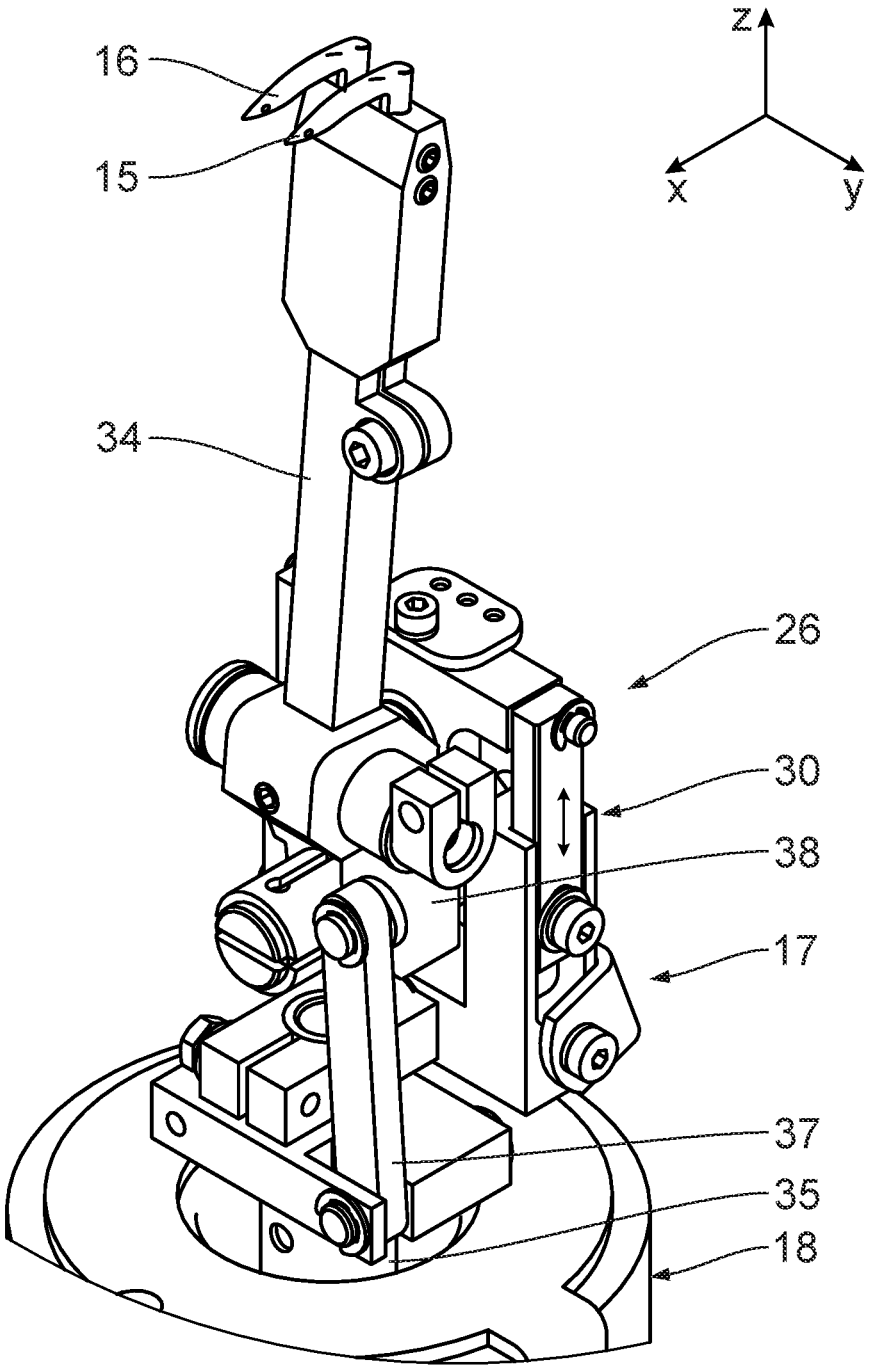
FIG. 6 is a view similar to that of FIG. 4 showing components of an articulated connection of the gripper lower part by way of which a two-dimensional gripper movement is driven, seen from a viewing direction that is approximately counter to that of FIG. 4.
Figure 7:
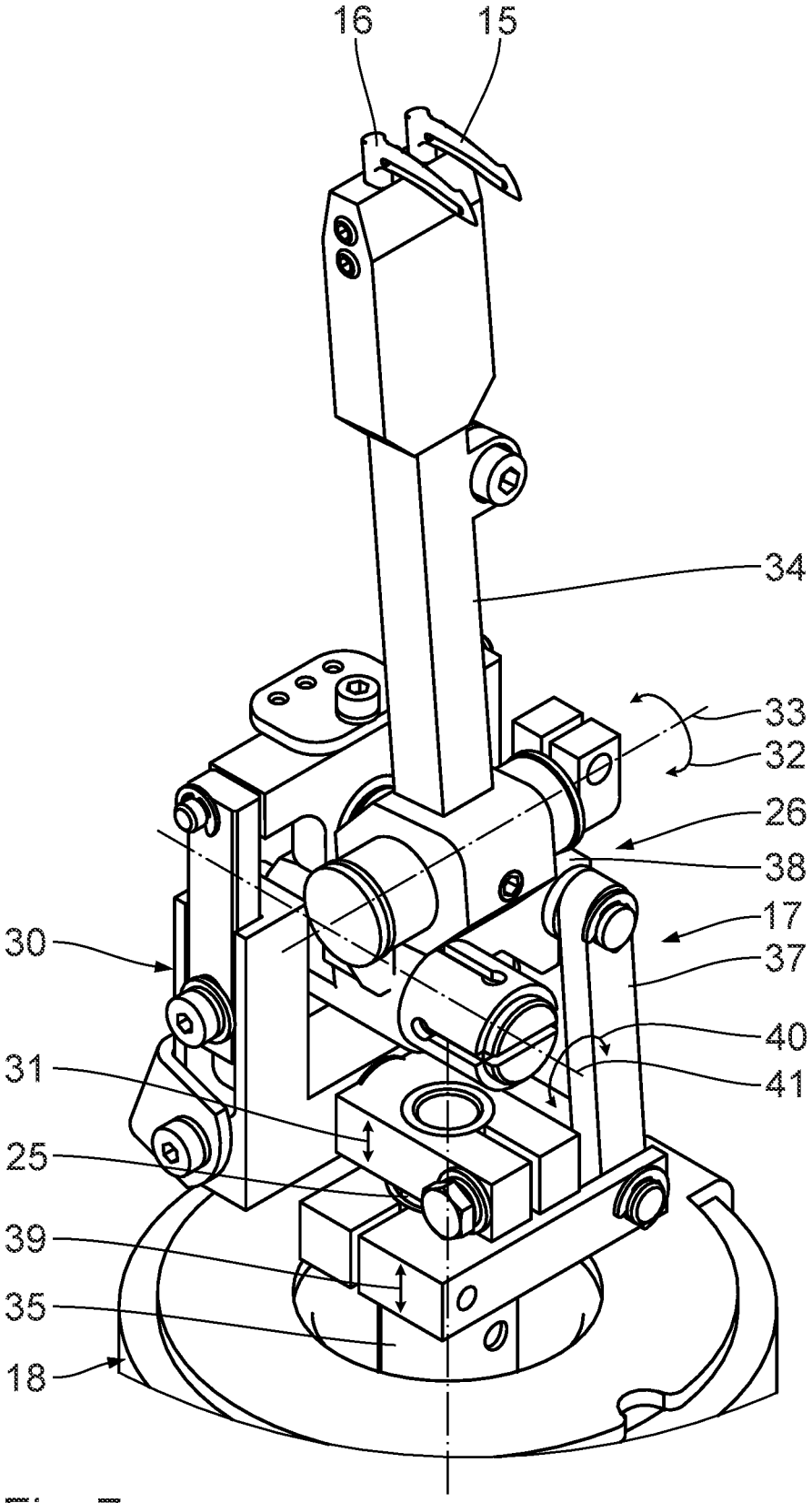
FIG. 7 is a view similar to that of FIGS. 4 and 6 showing the articulated connection of the gripper lower part, seen from a viewing direction which in relation to that of FIGS. 4 and 6 is rotated by approximately 90°.

The sewing machine 2 has two sewing needles 9, 10 (cf. FIG. 2) as stitch-formation components, which are supported by a common needle bar 11 (cf. FIG. 3). The needle bar 11 in a needle-bar upper part 12 is mounted so as to be driven in an upward and downward manner along the longitudinal axis 13 of the former.

The needle-bar upper part 12 in turn in a sewing-thread upper part 14 is mounted so as to be pivotable, specifically so as to be rotatable by 360°, in a driven manner about the needle-bar longitudinal axis 13. The needle-bar longitudinal axis 13 runs parallel with the z-axis.

The sewing-head upper part 14 forms an end-side portion of the housing upper part 6.

Two grippers 15, 16 serve as further stitch-formation components, said grippers 15, 16 on a gripper lower part 17 being mounted so as to be driven in a synchronous manner with the sewing needles 9, 10 in order for stitches to be formed. The gripper lower part 17 forms a column of the sewing machine 2. The gripper lower part 17, in turn, in a sewing-head lower part 18 is mounted so as to be pivotable in a driven manner, and in a manner synchronous with the needle-bar upper part 12, about the needle-bar longitudinal axis 13. The sewing-head lower part 18 represents an end-side portion of the housing lower part 7.

By virtue of the column design of the gripper lower part 17 and of the sewing-head lower part 18 a stitch-formation region in which the seam is generated by the sewing machine 2 is very freely accessible from all sides.

In the formation of stitches, the two sewing needles 9, 10 are driven in an upward and downward manner along the needle-bar longitudinal axis 13, and moreover, for transporting the needle, are driven so as to oscillate in the +/−x-direction. In a manner synchronous therewith, a pivoting movement of the grippers 15, 16 is driven so as to have an oval movement path that lies approximately parallel with the x-y plane. An x-component of this movement oval of the grippers 15, 16 herein is larger than a y-component.

Driving these stitch-formation movements of the sewing needles 9, 10 and of the grippers 15, 16 is performed so as to be driven by a sewing drive motor 19 which is accommodated in the post 8 of the housing 5. The sewing drive motor 19 by way of a miter gear 20 mounted therebelow and a timing belt 21 drives a sewing-drive lower shaft 22 which in the housing lower part 7 runs parallel with the y-axis up to the sewing-head lower part 18. Two tappets 23, 24 which are accommodated in the sewing-head lower part 18 and for synchronous driving are interconnected in terms of drive technology by way of a timing-belt connection are driven by way of the lower shaft 22.

On the take-off side, the tappet 23 is connected to a sliding internal shaft 25 which runs parallel with the z-axis through the sewing-head lower part 18 up to an articulated connection 26 (cf. FIGS. 4 to 7) by way of which the grippers 15, 16 are connected to the rotatable gripper lower part 17. An operative connection between the tappet 23 and the sliding internal shaft 25 is performed by way of an annular follower 27. In the rotation of the gripper lower part 17 in relation to the sewing-head lower part 18, about the needle-bar longitudinal axis 13 which coincides with the sliding-shaft longitudinal axis, the sliding internal shaft 25 is rotated in a sliding eyelet 28 of the tappet 23. An axis of annular symmetry of the sliding eyelet 28 coincides with the needle-bar longitudinal axis 13.

A feed control lever 29 is fixed to the sliding internal shaft 25 on the gripper-side end facing away from the annular follower 27. A pivot-lever functional group 30 which converts a z-oscillating movement (cf. double arrow 31 in FIG. 7) of the feed control lever 29 to a rotating oscillating movement (cf. double arrow 32 in FIG. 7) about a gripper main pivot axis 33 which is parallel with the y-axis is assembled on said feed control lever 29.

A gripper carrier 34 on which the two grippers 15, 16 are assembled is connected in a rotationally fixed manner to the pivot-lever functional group 30.

The second tappet 24 in the sewing-head lower part 18 by way of a respective annular follower 27 and a sliding eyelet 28 is connected to a sliding external shaft 35. The second tappet 24 converts the rotating movement of the lower shaft 22 to a z-oscillating movement of the sliding external shaft 35. The sliding external shaft 35 surrounds the sliding internal shaft 25 and conjointly with the latter is mounted so as to be rotatable in the sewing-head lower part 18.

In turn, a feed control lever 36 on which a pivot lever 37 is articulated is fixed to the sliding external shaft 35 on the gripper-side end facing away from the annular follower 27. Said pivot lever 37 is articulated on a main body 38 of the articulated connection 26, said main body 38 being fixedly connected to the gripper carrier 34. The pivot lever 37 converts a z-oscillating movement (cf. double arrow 39 in FIG. 7) of the feed control lever 36 to a rotating/oscillating movement (cf. double arrow 40 in FIG. 7) of the main body 38 about a gripper secondary pivot axis 41.

A combination of pivoting the gripper carrier 34 having the main body 38 about the gripper main pivot axis 33, on the one hand, and about the gripper secondary pivot axis 41, on the other hand, provides the oval movement path of the grippers 15, 16 in the x-y plane, as has already been mentioned above. This movement path is performed so as to be synchronized with the movement of the needle bar 11, the drive of the latter being explained hereunder.

By way of a further timing belt 42, a rotating movement of the lower shaft 22 is converted to a rotating movement of an upper shaft 43 which runs parallel with the y-direction in the housing upper part 6. The upper shaft 43 drives a crank 44 which by way of an annular follower 45 is connected to the needle bar 11 for driving the upward and downward movement of the latter along the z-axis. When the needle-bar upper part 12 is rotated in the sewing-head upper part 14, the annular follower 45 forms a tongue-and-groove connection to an annular member 46 that is connected in a rotationally fixed manner to the needle bar 11, and to a fork component that interacts with the latter and is fixedly connected to the crank 44. An axis of annular symmetry of the annular member 46 coincides with the needle-bar longitudinal axis 13.

The rotating movement of the upper shaft 43 by way of a coupling is converted to a rotating movement of a needle feed/presser foot drive shaft 47 which in FIGS. 1 and 2 is disposed in front of the upper shaft 43 and obscures the latter in portions.

The needle feed/presser foot drive shaft 47 drives a needle feed tappet 48 and a presser foot tappet 49.

A feed control lever 51, oscillating in the z-direction (cf. double arrow 50 in FIG. 2), of the needle feed tappet 48, by way of a fork-shaped articulated lever 52 and the tongue-and-groove connection 53 is connected to an annular member 54. An axis of annular symmetry of the annular member 54 coincides with the needle-bar longitudinal axis 13. Two mutually opposite springs of the fork of the articulated lever 52 herein engage in an encircling groove of the annular member 54. The annular member 54 is connected in a rotationally fixed manner to the needle-bar upper part 12. In a manner corresponding to the drive by way of the articulated lever 52, the annular member 54 is movable axially in relation to a main body of the needle-bar upper part 12 (cf. double arrow 55 in FIG. 3). A needle feed lever 57 (cf. FIG. 3) which by way of a further articulated connection 58 is connected to the main body of the needle-bar upper part 12 is articulated on the annular member 54 by way of an articulated connection 56. The needle feed lever 57 by way of a bolt 59 is connected to a guide 60 of the needle bar 11 which at the same time also represents a guide for a presser foot bar 61 of a presser foot 62.

The oscillating movement 55 of the annular member 54 thus leads to a needle-feed oscillating movement (cf. double arrow 63 in FIG. 3) of the sewing needles 9, 10, said movement being conjoint with that of the presser foot 62 in the x-z plane.

The presser foot tappet 49 by way of a further feed control lever 64 which oscillates in a driven manner in the z-direction (cf. double arrow 65 in FIG. 2) interacts with a further fork-shaped articulated lever 66 which likewise by way of a tongue-and-groove connection 53 interacts with an annular member 67 of the needle-bar upper part 12. An axis of annular symmetry of the annular member 67 coincides with the needle-bar longitudinal axis 13. On account thereof, a z-oscillating movement of the annular member 67 is caused (cf. double arrow 68 in FIG. 3). The annular member 67 in terms of thrust is connected to the presser foot bar 61. The oscillating movement 68 of the annular member 67 is thus converted to a corresponding reciprocating movement of the presser foot 62.

Independently of the drive of the stitch-formation components by way of the sewing drive motor 19, driving the needle-bar upper part 12, on the one hand, and the gripper lower part 17, on the other hand, about the needle-bar longitudinal axis 13 is performed in a pivoting or rotating manner, respectively.

This drive is accomplished by a rotating motor 69 which by way of a timing belt 70 drives a rotating drive shaft 71 which in a manner parallel with the z-axis runs in the post 8 between the housing upper part 6 and the housing lower part 7. A first, upper gear wheel 72 is connected in a rotationally fixed manner to the rotating drive shaft 71 so as to be level in height with the housing upper part 6, and a second, lower gear wheel 73 is connected in a rotationally fixed manner to the rotating drive shaft 71 so as to be level in height with the housing lower part 7.

The upper gear wheel 72 by way of a timing belt 74 that runs in the housing upper part 6 drives a gear wheel 75 which is connected in a rotationally fixed manner to the main body of the needle-bar upper part 12. In a manner parallel therewith, the lower gear wheel 73 by way of a timing belt 76 that runs in the housing lower part 7 drives a gear wheel 77 which is connected in a rotationally fixed manner to a main body of the gripper lower part 17. The pivoting actions, or rotating actions, respectively, of the needle-bar upper part 12 in the sewing-head upper part 14, on the one hand, and of the gripper lower part 17 in the sewing-head lower part 18, on the other hand, are mutually synchronized by way of the rotating drive shaft 71.

The sewing machine 2 for sewing the seam that lies multi-dimensionally in space is positioned by way of a central control 78, schematically illustrated in FIG. 1, which (in a manner not illustrated) in terms of a signal link is connected to the drive components of the sewing system 1, by actuating the robot 4 in a corresponding manner. The stitch-formation tools 9, 10, 15, and 16 subsequently follow the predefined seam profile. Depending on the topography of the components to be sewn, and depending on the seam profile, the needle-bar upper part 12, and in a manner synchronous thereto, the gripper lower part 17 are pivoted in a mutually synchronous manner about the needle-bar longitudinal axis 13 in relation to the housing 5. In this way, sewing locations that are difficult to access can also be reached.

While specific embodiments of the invention have been shown and described in detail to illustrate the application of the principles of the invention, it will be understood that the invention may be embodied otherwise without departing from such principles.

The invention claimed is:

1. A sewing system for sewing seams which lie multi-dimensionally in space, the sewing system comprising:

a sewing head comprising a needle-bar upper part, a sewing-head upper part, a gripper lower part and a sewing-head lower part, wherein a needle bar is mounted in the needle-bar upper part so as to be driven in an upward and downward manner along a longitudinal axis of the needle bar, at least one sewing needle being held as a stitch-formation tool on the needle bar, the needle-bar upper part being mounted in the sewing-head upper part so as to be pivotable in a driven manner about the longitudinal axis of the needle bar, at least one gripper being mounted on the gripper lower part as a stitch-formation tool that is driven in a manner synchronous with the at least one sewing needle, the gripper lower part being mounted in the sewing-head lower part so as to be pivotable in a driven manner, and in a manner synchronous with the needle-bar upper part, about the longitudinal axis of the needle bar;

motor components for driving upward and downward movement of the needle bar, pivoting the needle-bar upper part, driving the at least one gripper in a manner synchronous with the needle bar and pivoting the gripper lower part, the motor components being disposed outside the needle-bar upper part and outside the gripper lower part.

2. A sewing system as claimed in claim 1, wherein the needle-bar upper part and the gripper lower part are mounted in the sewing-head upper part and in the sewing-head lower part, respectively, so as to be rotatable by 360°.

3. A sewing system as claimed in claim 1, wherein the needle-bar upper part is operatively connected to at least one of the motor components via at least one tongue-and-groove connection for driving the upward and downward movement of the needle bar, the at least one tongue-and-groove connection comprising an annular member having one of a groove and a tongue, wherein an axis of annular symmetry of the annular member one of coincides with the longitudinal axis of the needle bar and is parallel with the longitudinal axis of the needle bar.

4. A sewing system as claimed in claim 1, further comprising a presser foot which in the needle-bar upper part in a driven manner is capable of reciprocating along a longitudinal axis of said presser foot, wherein the needle-bar upper part is operatively connected to at least one of the motor components via at least one tongue-and-groove connection for driving a reciprocating movement of the presser foot, the at least one tongue-and-groove connection comprising an annular member having one of a groove and a tongue, wherein an axis of annular symmetry of the annular member one of coincides with the longitudinal axis of the needle bar and is parallel with the longitudinal axis of the needle bar.

5. A sewing system as claimed in claim 1, wherein the needle-bar upper part is operatively connected to at least one of the motor components via at least one tongue-and-groove connection for driving a sewn goods transport movement of the needle bar, the at least one tongue-and-groove connection comprising an annular member having one of a groove and a tongue, wherein an axis of annular symmetry of the annular member one of coincides with the longitudinal axis of the needle bar and is parallel with the the longitudinal axis of the needle bar.

6. A sewing system as claimed in claim 1, further comprising at least one tappet for converting a rotation of a drive shaft to at least one of a transport movement of the needle bar and a reciprocating movement of a presser foot, wherein the at least one tappet interacts with an annular member via at least one tongue-and-groove connection.

7. A sewing system as claimed in claim 1, wherein at least one sliding shaft is disposed in the gripper lower part so as to be parallel with a pivot axis of the gripper lower part, the at least one sliding shaft for driving a gripper movement interacting with the at least one gripper via an articulated connection.

8. A sewing system as claimed in claim 7, further comprising at least one tappet for converting a rotation of a drive shaft to an upward and downward movement of the at least one sliding shaft for driving the at least one gripper wherein the at least one tappet interacts with an annular member via at least one tongue-and-groove connection.

9. A sewing system as claimed in claim 1, wherein a gripper drive drives the at least one gripper along two mutually perpendicular movement components.

10. A sewing system as claimed in claim 1, wherein the gripper lower part is operatively connected to at least one of the motor components via at least one tongue-and-groove connection for driving the at least one gripper, the at least one tongue-and-groove connection comprising an annular member having one of a groove and a tongue.

* * * * *